US005194732A

United States Patent [19]

Bateman

[11] Patent Number: 5,194,732

[45] Date of Patent: Mar. 16, 1993

[54] CHARGED-PARTICLE ENERGY ANALYZER AND MASS SPECTROMETER INCORPORATING IT

[76] Inventor: Robert H. Bateman, 15 Lynton Close, Knutsford, Cheshire WA16 8BH, England

[21] Appl. No.: 777,304

[22] PCT Filed: Jun. 1, 1990

[86] PCT No.: PCT/GB90/00845

§ 371 Date: Dec. 2, 1991

§ 102(e) Date: Dec. 2, 1991

[87] PCT Pub. No.: WO90/15434

PCT Pub. Date: Dec. 13, 1990

[30] Foreign Application Priority Data

Jun. 1, 1989 [GB] United Kingdom ..... 8912580

[51] Int. Cl.[5] ..... H01J 49/48; H01J 49/32

[52] U.S. Cl. ..... 250/294; 250/296; 250/305; 250/396 R

[58] Field of Search ..... 250/294, 296, 305, 396 R

[56] References Cited

U.S. PATENT DOCUMENTS

| | | |
|---|---|---|
| 3,407,323 | 10/1968 | Hand . |
| 3,636,345 | 1/1972 | Hirschel . |
| 4,912,326 | 3/1990 | Naito . |

FOREIGN PATENT DOCUMENTS

| | | |
|---|---|---|
| 0202117 | 11/1986 | European Pat. Off. . |
| 2648466 | 4/1978 | Fed. Rep. of Germany . |
| 3922996 | 2/1990 | Fed. Rep. of Germany . |
| 2620858 | 3/1989 | France . |
| 61-161645 | 7/1986 | Japan . |
| 61-206155 | 9/1986 | Japan . |
| 61-253760 | 11/1986 | Japan . |
| 851547 | 12/1981 | U.S.S.R. . |
| 1-91257 | 7/1984 | U.S.S.R. . |
| 2216331 | 4/1989 | United Kingdom . |
| 2221566 | 2/1990 | United Kingdom . |

OTHER PUBLICATIONS

Dymovich, Sysoev, "Calculation And Some Ion-Optical Characteristics Of An Electrostatic Focussing System", published on Physical Electronics (Moscow) 1965, vol. 2, pp. 15–25, an English Translation is enclosed. (Exhibit D).

Dymovich, Sysoev, "Calculation Of The Field Of An Electrostatic Focussing System and Modelling In An Electrolytic Bath", published on Physical Electronics (Moscow) 1965, vol. 2, pp. 27–32, an English translation is enclosed. (Exhibit E).

Dymovich, Dorofeev, Petrov, "Triple Focusing Crossed Field Mass Spectrometer", published on Physical Electronics (Moscow) 1966 vol. 3, pp. 66–75, an English translation is enclosed. (Exhibit F).

Daukeev, Karetskaya, Kasymov, Kelman, Mit[1], Saichenko, Shevelev, "Secondary-ion mass spectrometer", published on Soviet Physics Technical Physics Mar. 1985, No. 3, Woodbury, N.Y., U.S.A. (Exhibit G).

Curtis, Hsieh, "Compact Wide-Aperture Hyperbolic Analyzers", published on Review of Scientific Instruments 59 (1988) Nov., No. 11, New York, N.Y., U.S.A. (Exhibit H).

Gibson, Reid, "A Modified Fountain Spectrometer For Meaasuring Double Differential Cross Sections In Ion-atom collisions", published on J. Phys. E: Sci Instrum., vol. 17, 1984, pp. 1227–1230. (Exhibit I).

Kelman, Rodnikova, Finogenov, "Prism Mass Spectrometer With Energy Focusing", published on Soviet Physics—Technical Physics 1971 vol. 16 (1) pp. 130–135. (Exhibit J).

*Primary Examiner*—Jack I. Berman

*Attorney, Agent, or Firm*—Merchant & Gould, Smith, Edell, Welter & Schmidt

[57] ABSTRACT

An electrostatic analyzer (1) for dispersing a beam of charged particles (10) according to their energy comprises two groups (2, 3) of spaced-apart linear electrodes (4, 8, 9, 20) respectively disposed above and below the charged particle beam. The potentials of the electrodes (4, 8, 9, 20) in each group progressively increase from one to the next, thereby providing an electrostatic field in a central plane (7) between the groups which is capable of deflecting the charged particles along different curved trajectories (11, 12) according to their energies. Various mass spectrometers incorporating such an analyzer are also disclosed.

21 Claims, 9 Drawing Sheets

CHARGED-PARTICLE ENERGY ANALYZER AND MASS SPECTROMETER INCORPORATING IT

This invention relates to a charged-particle energy analyzer suitable for use in a double focusing mass spectrometer, and to a mass spectrometer incorporating such an analyzer.

The most common type of charged-particle energy analyzer incorporated in mass spectrometers is a cylindrical sector electrostatic analyzer. Such an analyzer provides energy dispersion and first-order focusing along only one axis and is therefore well suited to combination with a magnetic sector mass analyzer to make a double focusing (i.e., both direction and velocity focusing) mass spectrometer. Unfortunately, cylindrical sector analyzers comprise two curved electrodes which must be machined to very close tolerances and are therefore expensive to manufacture. Further, the use of a cylindrical sector analyzer in a mass spectrometer fitted with a multi-channel detector for the simultaneous detection of more than one mass-to-charge ratio imposes some serious limitations on its performance. Firstly, because of the limited spacing between the electrodes, the extent of the focal plane is limited, so that the range of masses that can be simultaneously imaged is also limited. Secondly, the focal plane of such a conventional analyzer is not usually perpendicular to the direction of travel of the ions leaving it, but inclined at a shallow angle. This further limits the maximum extent of the spectrum which can be simultaneously recorded and complicates the design of the detector system. Further, because a conventional analyzer comprises only 2 electrodes, the electrostatic analyzing field is determined entirely by the shape of the electrodes. This means that the homogeneity of the field cannot be varied and the number of aberrations (e.g. focal plane tilt and curvature) which can be corrected is very limited. Similarly, although a greater mass range can be transmitted by use of an analyzer with a wider gap, it is then necessary to increase the height of the plates to ensure that the field in the vicinity of the ion beam is sufficiently uniform, and this often results in a very large and prohibitively expensive analyzer.

Very few analyzers are known which do not rely on the field generated between two accurately shaped electrodes to define the energy dispersing field. Auxiliary electrodes are used in prior analyzers to compensate for the effect of fringing fields where the charged-particle beam enters and leaves the analyzer, but these do not define the main analyzing field. In these analyzers, one or more electrodes are provided at the entrance and exit of the analyzer and are maintained at potentials such that the field between the main electrodes is maintained as close as possible to the ideal field (e.g., a 1/r field in the case of a cylindrical sector analyzer). Similar fringing-field corrector electrodes may be provided around the edges of a parallel-plate analyzer, (see, for example, Stolterfoht in DE2648466 A1).

Matsuda (Rev. Sci. Instrum. 1961, vol 32(7), pp 850–852) has described a variable focal length cylindrical sector analyzer which comprises a pair of conventional sector electrodes and a pair of planar auxiliary electrodes, respectively disposed above and below the sector electrodes (i.e., displaced along the "z" axis). Application of a potential difference between these electrodes results in curvature of the equipotential surfaces along the "z" axis so that the analyzer exhibits some focusing in the "z" direction. A similar concept is disclosed in JP 61-161645 A1 (1986). Matsuda also suggests replacing each of the planar auxiliary electrodes with a number of wires disposed in concentric circular arcs and applying different potentials to each wire in order to correct aberrations, but does not give details as to how this might be achieved in practice. In a later paper (Int. J. Mass Spectrom Ion Phys., 1976, vol 22, pp 95–102), Matsuda suggests using the auxiliary electrodes in conjunction with shims on the main electrodes to reduce the height of the main electrodes needed to obtain adequate field homogeneity. In all these analyzers however, the field in the analyzer is principally determined by the main sector electrodes.

Zashkvara and Korsunshii (Sov. Phys. Tech. Phys. 1963 vol 7(7) pp 614–619) describe an electrostatic energy analyzer which has focusing properties along both the "y" and "z" axes in which the main field-defining electrodes are disposed either side of the charged-particle beam along the Y-axis and comprise a stack of flat cylindrical sector electrodes insulated from each other. A resistive potential divider is used to feed each plate electrode with an appropriate potential. In this way an inhomogeneous field along the analyzer "z" axis can be created and the focusing properties of the analyzer adjusted in a similar way to the Matsuda analyzer. The Zashkvara analyzer does not incorporate any electrodes displaced from the charged-particle beam along the "z" axis.

Dymovich and Sysoev describe (Phys. Electronics, Moscow, 1965, vol 2, pp 15–26 and 27–32) an electrostatic analyzer which is very similar to that proposed by Matsuda. This analyzer comprises two groups of circular arc electrodes disposed one above and one below the ion beam, and two circular main electrodes in a conventional location on either side of the ion beam. The analyzer, intended for use in a crossed-field mass spectrometer, is described in considerable detail. Second and higher order aberrations are corrected by adjusting the potential gradient across the series of auxiliary electrodes in a similar way to that suggested by Matsuda. The analyzer as described involved no less than 76 circular arc electrodes (of different radii) and does not seem to have been adopted in any practical instrument, presumably due to the difficulty of its manufacture. A complete crossed-field mass spectrometer incorporating this electrode structure (called a "multi-electrode electrostatic focusing system, or EFS" by its designers) is described in a later paper (Dymovich, Dorofeev, and Petrov (Phys. Electronics, Moscow, 1966, vol 3, pp 66–75), but according to Soviet Inventors Certificate 851547 (1981) this instrument was found to be somewhat impractical due to the large size of the electrode structure. The solution proposed in SU 851547 is to form the circular arc electrodes as metallic deposits on a resistive substrate which is easier to manufacture, but removes one of the advantages proposed for the EFS in that the potential gradient between the electrodes is determined by the resistive substrate and cannot easily be adjusted to correct higher order aberrations.

It is an object of the present invention to provide an improved analyzer suitable for use in a double-focusing mass spectrometer which is easy and cheap to construct.

It is another object of the invention to provide various types of mass spectrometers incorporating such an analyzer, and in particular to provide double-focusing mass spectrometers incorporating such an analyzer.

Viewed from one aspect, the invention provides an electrostatic analyzer for dispersing a beam of charged particles according to their energy, said analyzer comprising two groups of spaced-apart linear electrodes respectively disposed above and below said beam, the more central electrodes are disposed, the potential of one electrode of the pair being more positive and the potential of the other electrode of the pair being more negative than the potential at which ions comprised in said beam enter the analyzer and the potentials of all the electrodes comprising each said group progressively increasing from one electrode to the next, thereby providing in a central plane between said groups of electrodes an electrostatic field which is capable of deflecting said charged particles along different curved trajectories according to their energies.

Preferably the linear electrodes comprising each group are disposed substantially parallel to one another and are arrayed in a plane parallel to the central plane of the analyzer.

Further preferably the upper and lower groups of electrodes are substantially identical and electrodes in corresponding positions in each group are maintained at the same potential.

Conveniently, one central electrode of each group is maintained at a potential V and the potentials of the other electrodes in the group are given by the polynomial expression:

$$V_E = V_M + V_A y_E + V_B y_E^2 + V_C y_E^3 + V_D y_E^4 + \ldots \quad 1$$

in which $V_E$ is the potential of a particular electrode, $y_E$ is the distance of said particular electrode from the electrode maintained at $V_M$ (positive in one direction, negative in the other), and $V_A$, $V_B$, $V_C$ and $V_D$ are constants.

Preferably the potential $V_M$ is the potential at which the ions enter the electrostatic analyzer (i.e., the potential of its entrance slit and central trajectory). Alternatively a pair of the central electrodes adjacent to one another may be maintained at potentials respectively positive and negative with respect to the potential at which the ions enter the analyzer.

The field E at any point in the central plane of the analyzer is therefore given by the polynomial expression:

$$E = E_O + E_1 y_E + E_2 y_E^2 + E_3 y_E^3 + \ldots \quad 2$$

In equation [2], $E_O - E_3$ are constants and $y_E$ is the distance from the electrode maintained at potential $V_M$ measured in the central plane. It will be seen that the field generated by an analyzer according to the invention is essentially a linear field modified by higher order terms such as $E_2 y_E^2$ and $E_3 y_E^3$ which can be varied by adjustment of the potentials applied to the electrodes. Such a field is unlike that of the prior multi-electrode analyzers which are based on curved electrodes of circular form and therefore generate a field proportional to 1/r (where r is the radius of a particular electrode).

Preferably the coefficient $V_A$ (equation [1]) is selected to adjust the deflection angle of the analyzer, the coefficient $V_B$ is selected to adjust the focal length. If higher order corrections are necessary, the coefficient $V_C$ can be selected to set the second order terms (e.g., the angle of the focal plane to the direction of travel of the charged particles as they leave the analyzer) and the coefficient $V_D$ selected to adjust the third order terms, (e.g., the curvature of the focal plane). Obviously, fourth and even higher order terms can be added to equation [1] and adjusted if desired.

In principle, an analyzer according to the invention does not require any electrodes at the side of the ion beam, as in prior conventional analyzers, because the field in the vicinity of the charged-particle beam is defined solely by the groups of electrodes. In practice however, the electrodes at each end of the groups may comprise a single electrode which extends through the central plane from the upper group to the lower group, thereby providing fringing field correction at the sides of the analyzer.

It will be appreciated that an analyzer according to the invention has in general a more extensive focal plane than a conventional two electrode analyzer of a similar size because the side electrodes, if provided at all, may be separated by a much greater distance than are the electrodes of a conventional analyzer. This is possible because the fringing field errors at the top and bottom of the analyzer, due primarily to the proximity of the analyzer vacuum housing, are insignificant because of the electrode structure, no matter how far apart the main electrodes are spaced, provided that a sufficient number of electrodes are provided. In this way the need to extend the electrodes along the "z" axis to reduce these fields is avoided. Further, unlike prior multi-electrode electrostatic analyzers the parallel linear-plate electrode structure allows a compact analyzer to be constructed very simply.

In a preferred embodiment, entrance and exit fringing field correction may be provided by two similar auxiliary electrode assemblies respectively disposed at the entrance and/or the exit of the main analyzer. Conveniently, the upper and lower groups of auxiliary electrodes are respectively arrayed in the same planes as the upper and lower groups of electrodes comprised in the main analyzer, and each auxiliary electrode is disposed in line with a corresponding electrode in the main analyzer.

In a most preferred embodiment, fringing field correctors are provided at the entrance and the exit of the main analyzer and the potential of the auxiliary electrodes is the same as the potential of the beam of charged particles as it approaches the analyzer. Normally, this potential is defined by the passage of a beam through a slit maintained at the same potential as the vacuum housing of the analyzer, usually ground potential. Conveniently, therefore, the auxiliary electrodes also may be maintained at ground potential. The auxiliary electrode assemblies may conveniently be of identical construction to the main analyzer save that the electrodes need only be about 25% of the length of the main analyzer electrodes and no insulation is required between them.

An analyzer incorporating fringing field correctors as described provides more effective correction than the conventional plate electrode comprising a slit.

The invention may further provide an electrostatic analyzer which comprises two or more multi-electrode segments wherein the electrodes are not all grounded and through which the charged particles pass sequentially. For example, such an electrostatic analyzer may be used in a variable dispersion mass spectrometer as described in PCT publication number WO 89/12315. Preferably, fringing field correction is provided on either side of the segments comprising the main analyzer by means of the auxiliary electrode assemblies described above.

The invention further provides a mass spectrometer comprising a source of charged particles, a detector of charged particles, a momentum analyzer for dispersing a beam of charged particles according to their mass-to-charge ratios, and an electrostatic analyzer as defined above for dispersing a beam of charged particles according to their energy.

Preferably, the momentum analyzer and the energy analyzer will cooperate to form an image on the detector which is both direction and velocity focused. In this way a double focusing mass spectrometer can be provided more economically than a conventional spectrometer having a cylindrical sector analyzer. Conveniently, the momentum analyzer is a magnetic sector analyzer, which may either precede or succeed the energy analyzer.

Although the charged-particle detector incorporated in a mass spectrometer according to the invention is typically a single-channel detector such as an electron multiplier or a Faraday cup detector, a multi-channel detector may also advantageously be used, particularly when the energy analyzer succeeds the momentum analyzer. In such a spectrometer a greater proportion of the mass spectrum can be simultaneously imaged on the detector than is possible with a sector analyzer because in the latter case the narrow gap between the sector electrodes imposes a serious limitation on the extent of its focal plane. In a spectrometer according to the invention, this limitation is far less severe because the gap between the side electrodes can be made very wide.

When used in a double-focusing spectrometer the coefficients $V_A - V_D$ (equation [1]) are selected to define the focusing characteristics of the analyzer and to minimize aberrations in the final image. Thus typically the coefficient $V_A$ is selected to define the deflection angle of the analyzer, the coefficient $V_B$ to define the focal length, and the coefficients $V_C$ and $V_D$ to define the focal plane tilt (that is, the angle of the focal plane to the direction of travel of the charged particles as they leave the analyzer) and curvature. These properties are of course selected in conjunction with the corresponding properties of the momentum analyzer to provide a double focusing mass spectrometer. However, it is an easier task to adjust the parameters in an analyzer according to the invention because they may be set by simply adjusting electrical potentials rather than by the geometrical properties of the analyzer such as radius and sector length. Consequently, the same analyzer can be employed in different types of mass spectrometer, resulting in considerable cost savings. It is even possible to alter the first order focusing characteristics, e.g., the position of the ion detector relative to the analyzer (and therefore the dispersion of the spectrometer) while still maintaining adequate second and higher order focusing. The construction of a variable dispersion (i.e., a "zoom") mass spectrometer is consequently facilitated. Such a spectrometer is particularly useful when a multichannel detector is employed.

The most convenient way of selecting the electrode potentials in any analyzer or spectrometer according to the invention is by the use of conventional computer ray-tracing programs. These programs allow the position and shape of the image focal plane to be predicted from a given set of electrode potentials by repetitively drawing the trajectories through the analyzer of ions of different energies and starting positions. An approximate set of potentials can therefore be established for any desired detector position, and final adjustment can be made on a complete spectrometer if means are provided for adjusting each potential within a narrow range. For example, the electrode potentials may be adjusted for maximum resolution.

The invention will now be described in greater detail by way of example only and by reference to the accompanying drawings, in which.

Figure 1:
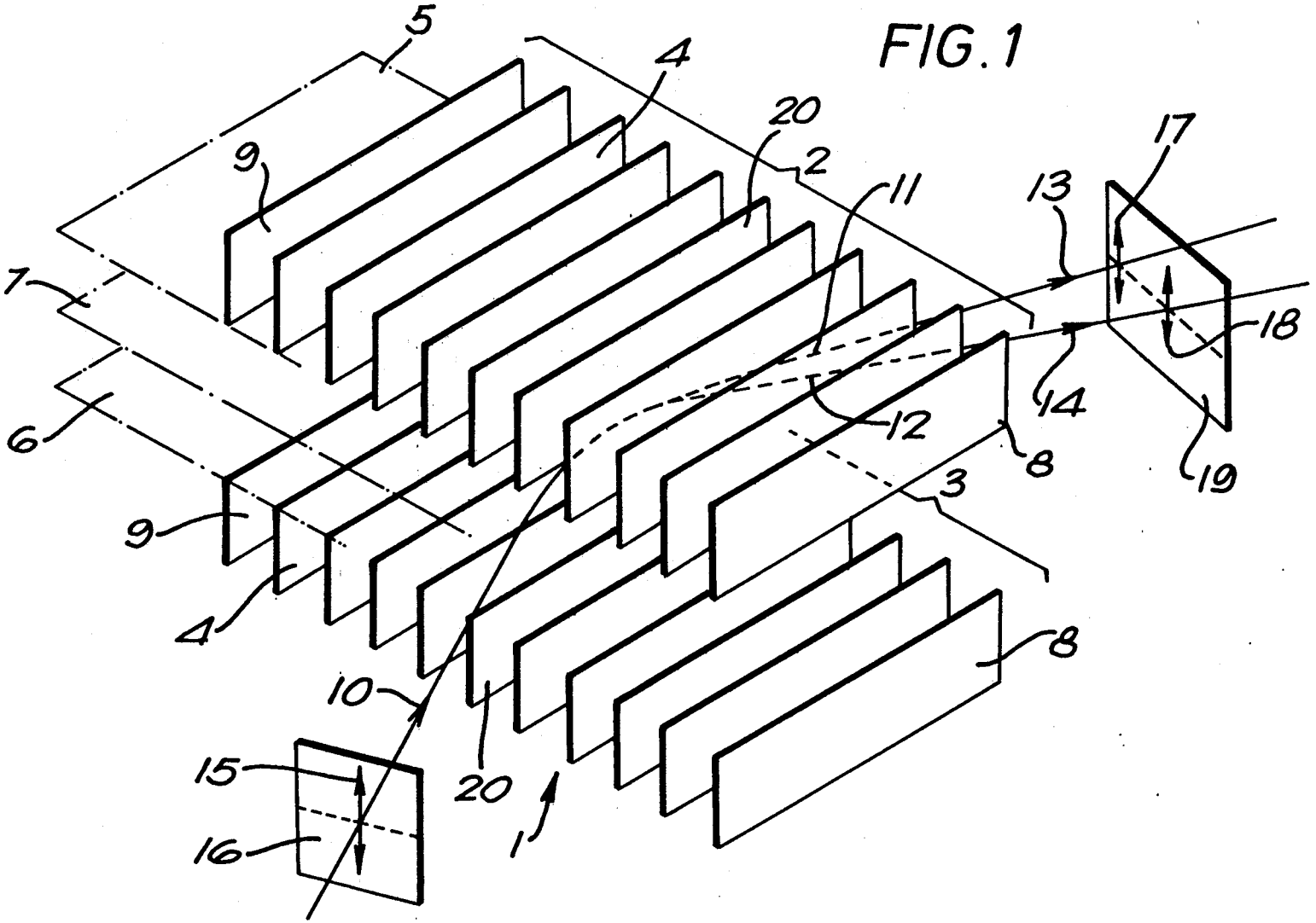
FIG. 1 is a schematic diagram of an electrostatic analyzer comprising groups of linear electrodes.

Referring first to FIG. 1, an electrostatic analyzer generally indicated by 1 comprises two groups 2 and 3 of spaced-apart linear electrodes, (e.g. 4,8,9,20) respectively disposed in planes 5 and 6 which are parallel to the central plane 7 of the analyzer. Potentials are applied to the electrodes in such a way that they become progressively more positive from electrodes 8 through to electrodes 9, so that a beam of positive charged particles 10, incident as shown and travelling in the central plane 7 is deflected within the analyzer in curved trajectories (e.g. 11 and 12) according to the energy of the particles to form a group of energy dispersed charged-particle beams 13, 14 leaving the analyzer. In the analyzer shown the two groups 2 and 3 of electrodes are substantially identical and electrodes in one group are electrically connected to the corresponding electrode in the other group, thereby ensuring that there is substantially no field along any axis within the analyzer perpendicular to planes 5, 6 and 7.

The field within the analyzer is such that an object 15 (defined, for example, by a narrow slit) located in the analyzer object plane 16 is focused to a series of energy dispersed images 17, 18 in the analyzer image plane 19 according to the energy of the charged particles comprised in the beam 10. For example, charged particles of one energy are deflected along the curved trajectory 11 to form the image 17 and charged particles of a lower energy are deflected along the curved trajectory 12 to form the image 18 at a different place in the image focal plane 19. Because there is no field perpendicular to planes 5, 6 and 7, the charged particles remain in the same plane in which they are travelling before they enter the analyzer.

In the analyzer shown in FIG. 1 there are an odd number of electrodes in each group and the central electrodes 20 of each group are maintained at the potential $V_M$, i.e. the potential of the entrance slit of the analyzer disposed in the object plane 16 and used to define the object 15. Alternatively, a pair of electrodes adjacent to one another in the middle of the array may be maintained at potentials respectively more positive and negative with respect to $V_M$ may be provided.

The exact shape of the trajectory of ions through the analyzer will of course be dependent on the way in which the potential varies between the electrodes 4,8, 9 and 20. If the potentials increase linearly from electrodes 8 through to electrodes 9, then positive ions will be deflected as shown in FIG. 1 and the trajectories 11 and 12 will be substantially parabolic. The field within the analyzer would then be substantially identical to that which would exist between two parallel straight electrodes disposed on either side of the ion beam. As explained, however, it is more useful to shift the electrode potentials according to the polynomial expression $$V_E = V_M + V_A y_E + V_B y_E^2 + V_C y_E^3 + V_D y_E^4 + \ldots \quad 1$$

where $V_E$ is the potential of a particular electrode, $V_M$ is the potential of the central electrode 20, $Y_E$ is the distance of that electrode from the central electrode, and $V_A$, $V_B$, $V_C$ and $V_D$ are constants.

Figure 2:
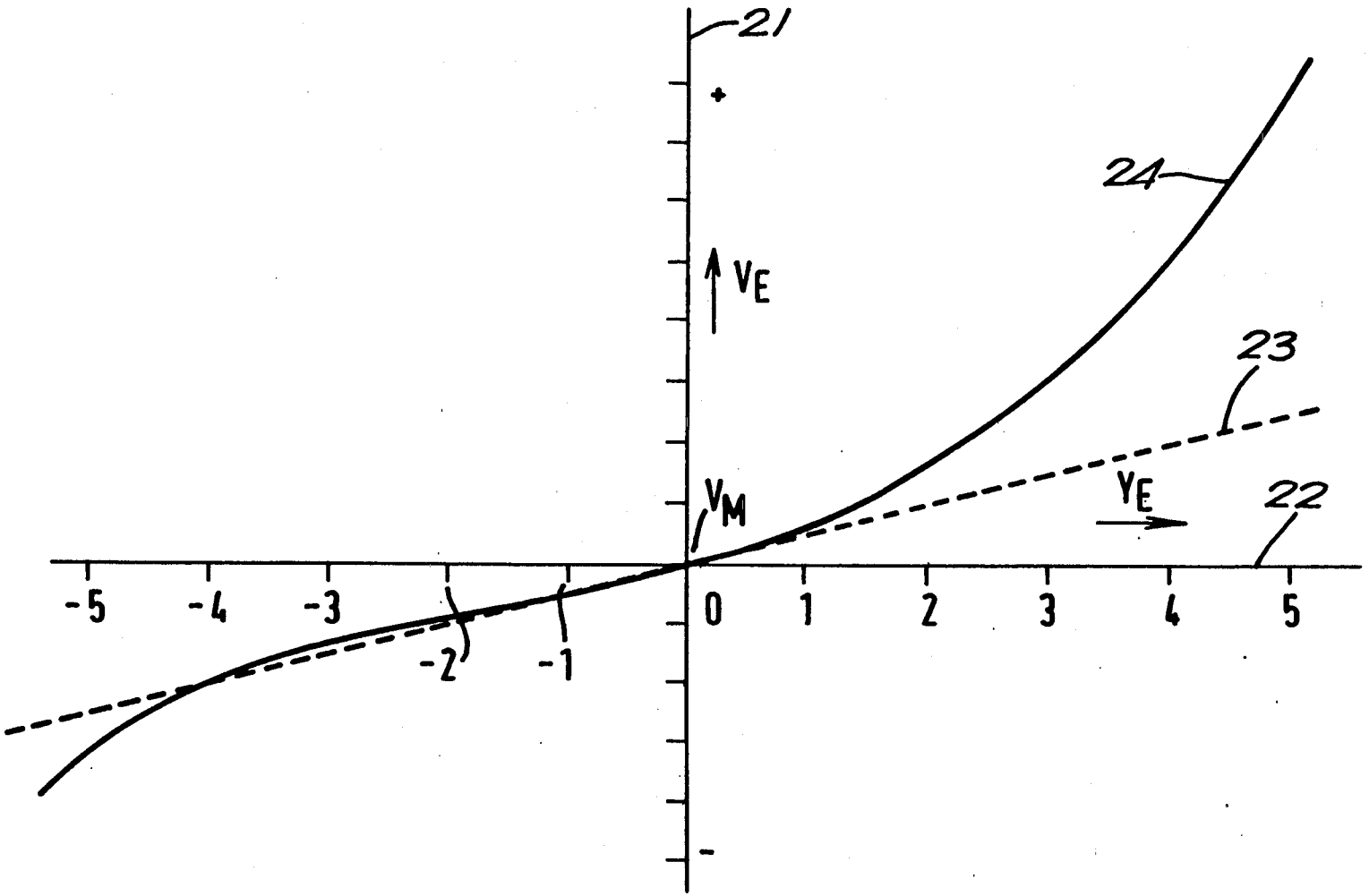
FIG. 2 is a plot of the potential of the electrodes comprising the analyzer in an exemplary case.

FIG. 2 is a plot of the potential on the electrodes relative to their position calculated using the constants $V_A = 1.0$, $V_B = 0.2$, $V_C = 0.05$ and $V_D = 0$, which are selected for illustrative purposes only. In FIG. 2, axis 21 represents the potential of the electrode $V_E$, and axis 22 the distance of the electrode from the central electrodes 20 ($Y_E$). The graph is drawn with its origin on the central electrode 20 (potential $V_M$, and $y_E = 0$). The broken line 23 represents a linear potential variation such as would be generated by two conventionally disposed main electrodes, and the curve 24 indicates the actual potential variation in an analyzer according to the invention for the constant values $V_A = 1$, $V_B = 0.2$, $V_C = 0.05$, $V_D = 0$. Strictly, curve 24 will comprise a series of short straight lines linking points lying on the curve where the potential is defined by the electrode itself. Clearly, it is necessary to use a sufficient number of electrodes to ensure that the practical deviations from curve 24 do not significantly detract from the analyzer performance. Approximately 11 electrodes 4 are sufficient for most applications, but advantage may be had in a very high performance analyzer by using twice that number, resulting in more accurate definition of the field.

It is of course not essential for the electrode defined above as the central electrode to be in the physical centre of the array of electrodes. It is within the scope of the invention to provide more electrodes on one side of the electrical centre than on the other.

Figure 3:
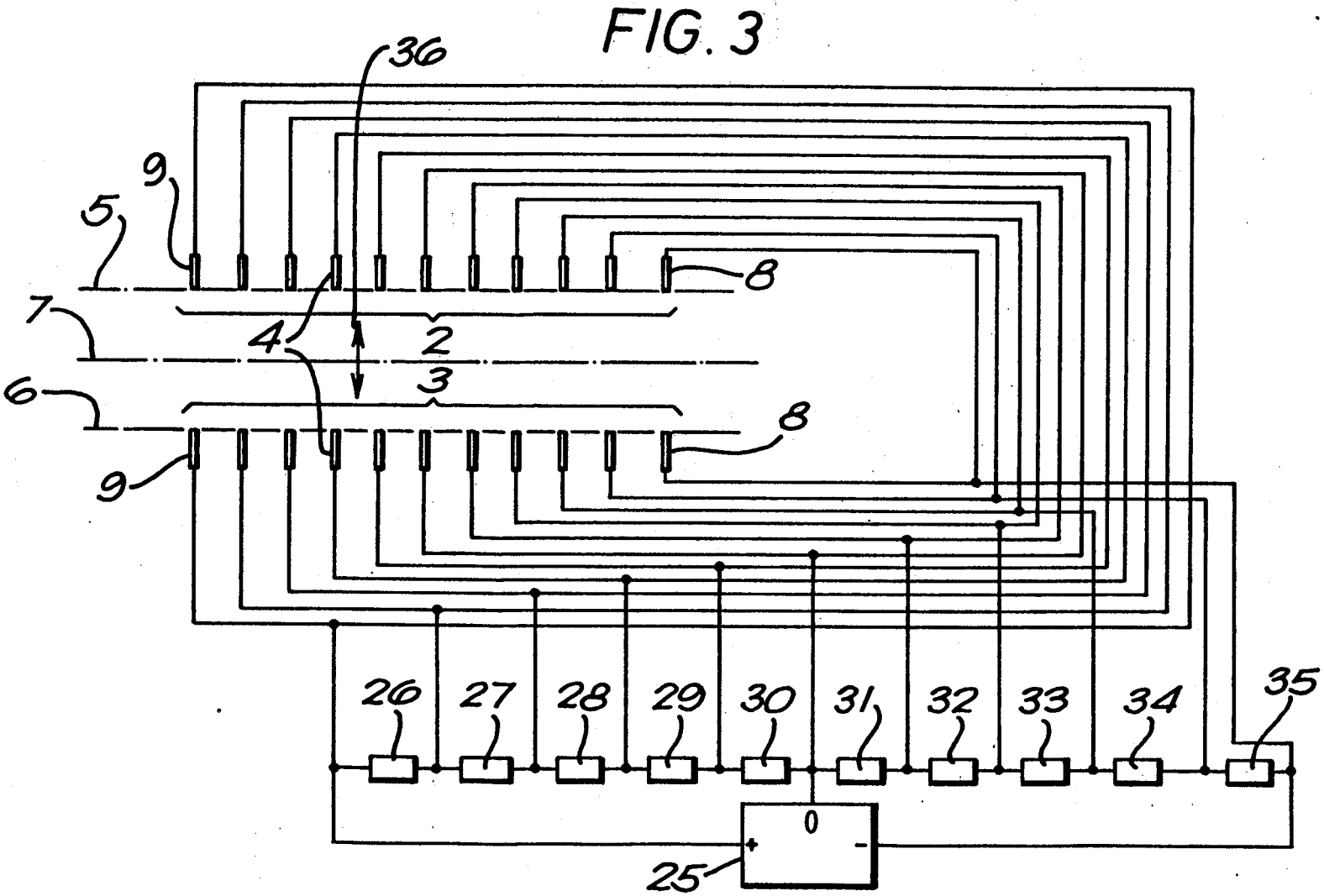
FIG. 3 is a circuit showing how the potentials may be applied to the electrodes of the analyzer.

FIG. 3 illustrates an electrical circuit used to supply the required potentials to the electrodes 4,8,9 and 20 disposed as in FIG. 1. A power supply 25 provides equal positive and negative voltages to electrodes 8 and 9 as shown, and the central electrodes 20 are connected to the 0 volts connection of the supply, which is maintained at potential $V_M$, typically ground potential. The other electrodes 4 are fed by taps on a potential divider comprising resistors 26–35 which are selected so that the potential on each electrode is as defined by the curve 24 of FIG. 2. Also apparent from FIG. 3 is the connection of each electrode in the upper group 2 to the corresponding electrode in the lower group 3, thereby ensuring that there is substantially no field along an axis (e.g. 36, FIG. 3) perpendicular to planes 5,6, and 7.

If more than one set of electrode potentials is required, two or more chains of resistors may be provided and a multiple switch employed to change the electrode connections from one chain to the other when required.

In order to provide an easy means of adjusting the electrode potentials especially during optimization experiments, each electrode 4 may be connected to the sliding contact of a potentiometer which forms part of the potential divider. Alternatively, the potential of each electrode may be controlled digitally by means of a conventional voltage controlling circuit incorporating a digital-to-analogue converter. A suitably programmed computer may then be employed to set the electrical potentials to whatever value is necessary. This method of controlling the electrode potentials is especially useful when many different sets of electrode potentials are required Referring next to FIG. 5, an electrostatic analyzer according to the invention having fringing field correction comprises a main analyzer 65 similar to that illustrated in FIG. 1, an entrance fringing field corrector 68, and an exit fringing field corrector 71. The main analyzer 65 comprises an upper group of electrodes 66 and a lower group of electrodes 67. The electrodes comprised in each group 66 and 67 are maintained at progressively increasing potentials as previously described.

The entrance fringing field corrector 68 comprises an upper group of electrodes 69 and a lower group of electrodes 70, and the exit fringing field corrector 71 comprises similar groups 72 and 73. Each of the electrodes in groups 69, 70, 72 and 73 is aligned with an electrode in the groups 66 or 67 in order to obtain the best correction, and all the electrodes in groups 69, 70, 72 and 73 are maintained at the potential at which the beam enters the analyzer, (typically ground potential). The side electrodes (e.g., 75, 76, 77) of each group, including those of the main analyzer 65, extend from the upper group (66, 69 or 72) through the central plane 74 of the analyzer to form the corresponding side electrode of the lower group (67, 70 or 73). These side electrodes provide fringing field correction at the sides of the analyzer and significantly reduce the interference to the electrostatic field inside the analyzer which might otherwise result from the proximity of a grounded vacuum enclosure. The electrodes in the groups 69, 70, 72 and 73 are typically approximately 25% of the lengths of the electrodes in the groups 66 and 67 which comprise the main analyzer 65.

Figure 4:
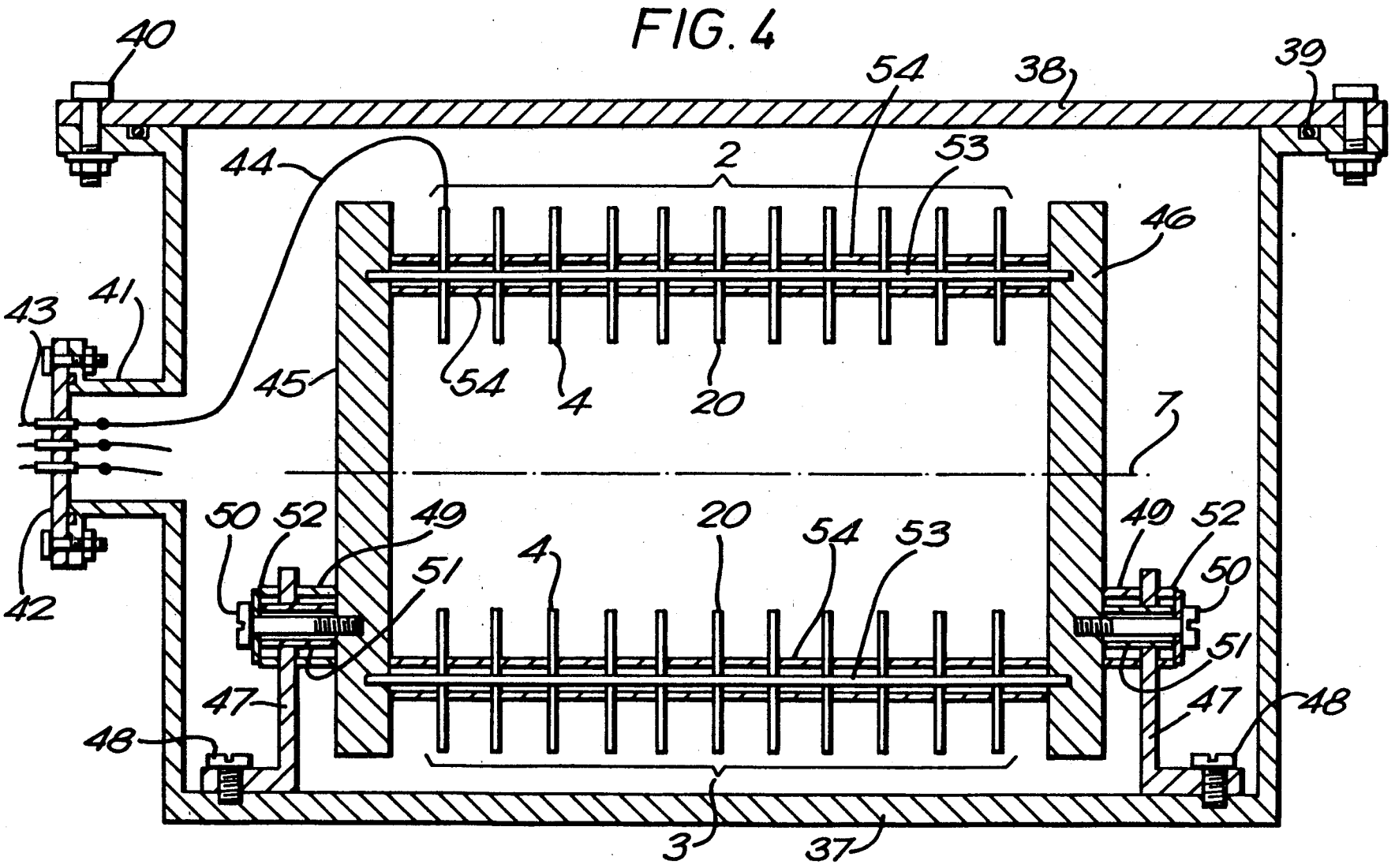
FIG. 4 is a sectional drawing of an analyzer according to the invention.

Referring next to FIG. 4, an electrostatic analyzer suitable for use in the invention is enclosed in a vacuum housing 37 closed by a lid 38 sealed with an 'O' ring 39 and secured by bolts 40. A port 41, closed by an 'O' ring sealed flange 42 which carries a number of electrical feedthroughs 43, is provided to allow electrical connection to be made to the electrodes comprising the analyzer (e.g., lead 44).

The analyzer itself comprises two side electrodes 45, 46 which comprise rectangular straight plates which extend through the central plane 7 of the analyzer. Side electrodes 45, 46 comprise the end electrodes 8 and 9 of the schematically represented electrode structures of FIGS. 1 and 3. As explained, this provides fringing field correction at the edges of the analyzer and reduces the distance that the electrode structure needs to extend in order to ensure that the field is properly defined in the vicinity of the ion beam passing through the analyzer.

The side electrodes 45 and 46 are supported on four insulated mountings (two for each electrode) from brackets 47 which are secured to the floor of the vacuum housing 37 with screws 48. Each of the insulated mountings comprises a ceramic tube 49 and is secured by a screw 50 fitted with a ceramic sleeve 51, and a short ceramic tube 52 is fitted under the head of screw 50 as shown.

The upper group 2 and the lower group 3 of electrodes (e.g., 4, 20) are are each supported on two ceramic rods 53 which are located in holes drilled in the side electrodes 45 and 46. Electrodes 4 are spaced apart by ceramic bushes 54. Each electrode 4 consists of a thin (e.g. 0.5 mm) rectangular metallic plate approximately the same length as the side electrodes. The height of the electrodes should be several times (e.g., five to ten times) their spacing for the effect of fringing fields to be negligible. Typically, the electrodes may be spaced 5 mm apart.

Figure 7:
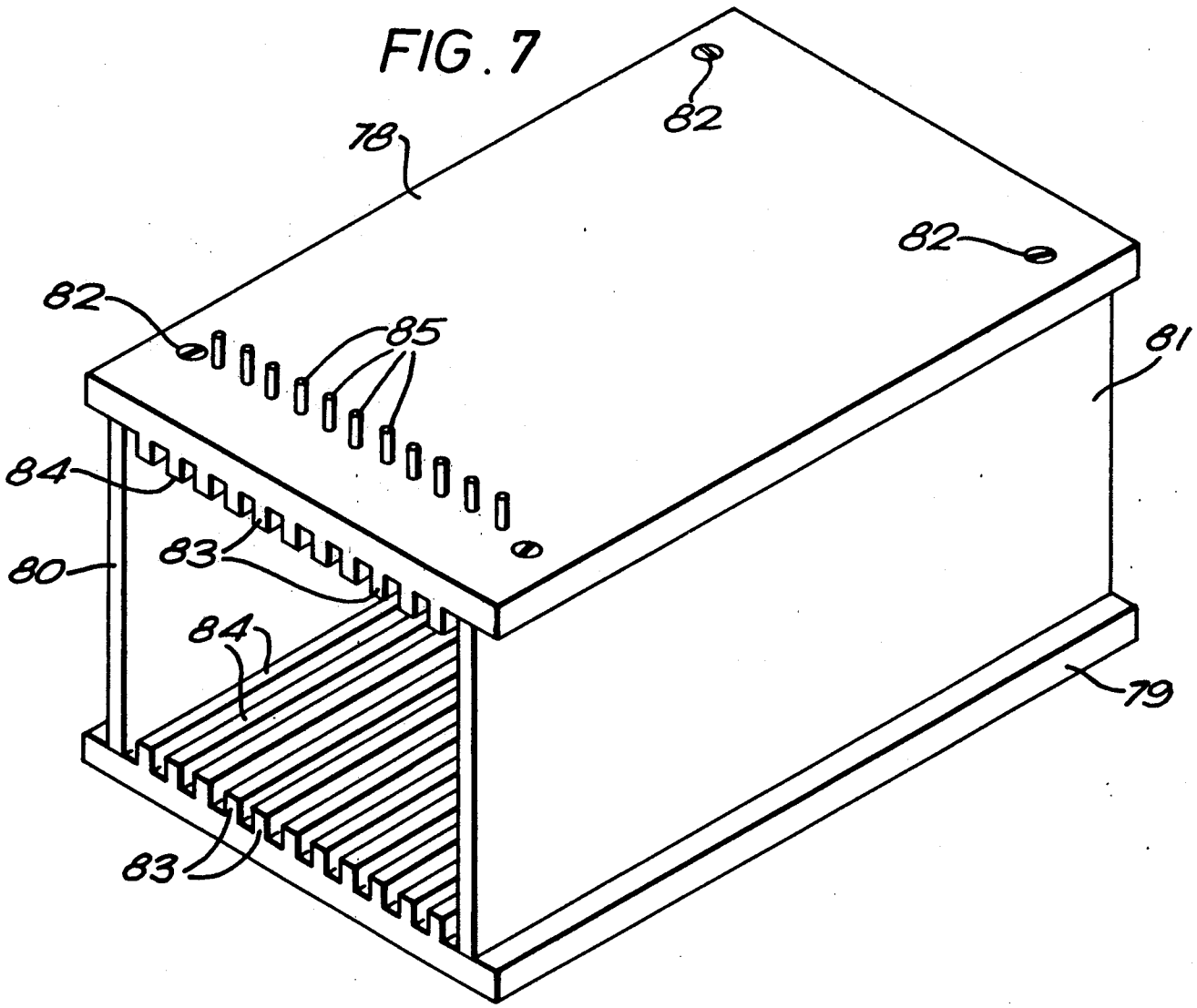
FIG. 7 is a drawing showing an alternative construction of an analyzer according to the invention.

An alternative way in which an analyzer according to the invention can be constructed is illustrated in FIG. 7. Two insulating (for example, ceramic) plates 78, 79 are spaced apart as shown by metallic side electrodes 80, 81 which correspond to the side electrodes 45, 46 shown in FIG. 4. Screws 82 secure the insulating plates 78, 79 to the electrodes 80 and 81. Each plate 78, 79 comprises a series of ridges 83 which are parallel to the side electrodes 80 and 81 and which are coated with an electrically conductive deposit 84 (e.g., a metallized film) to create the individual electrodes. Electrical connection is made to each electrode by means of the connection posts (e.g. 85) which pass through holes in the plates 78 and 79.

Figure 5:
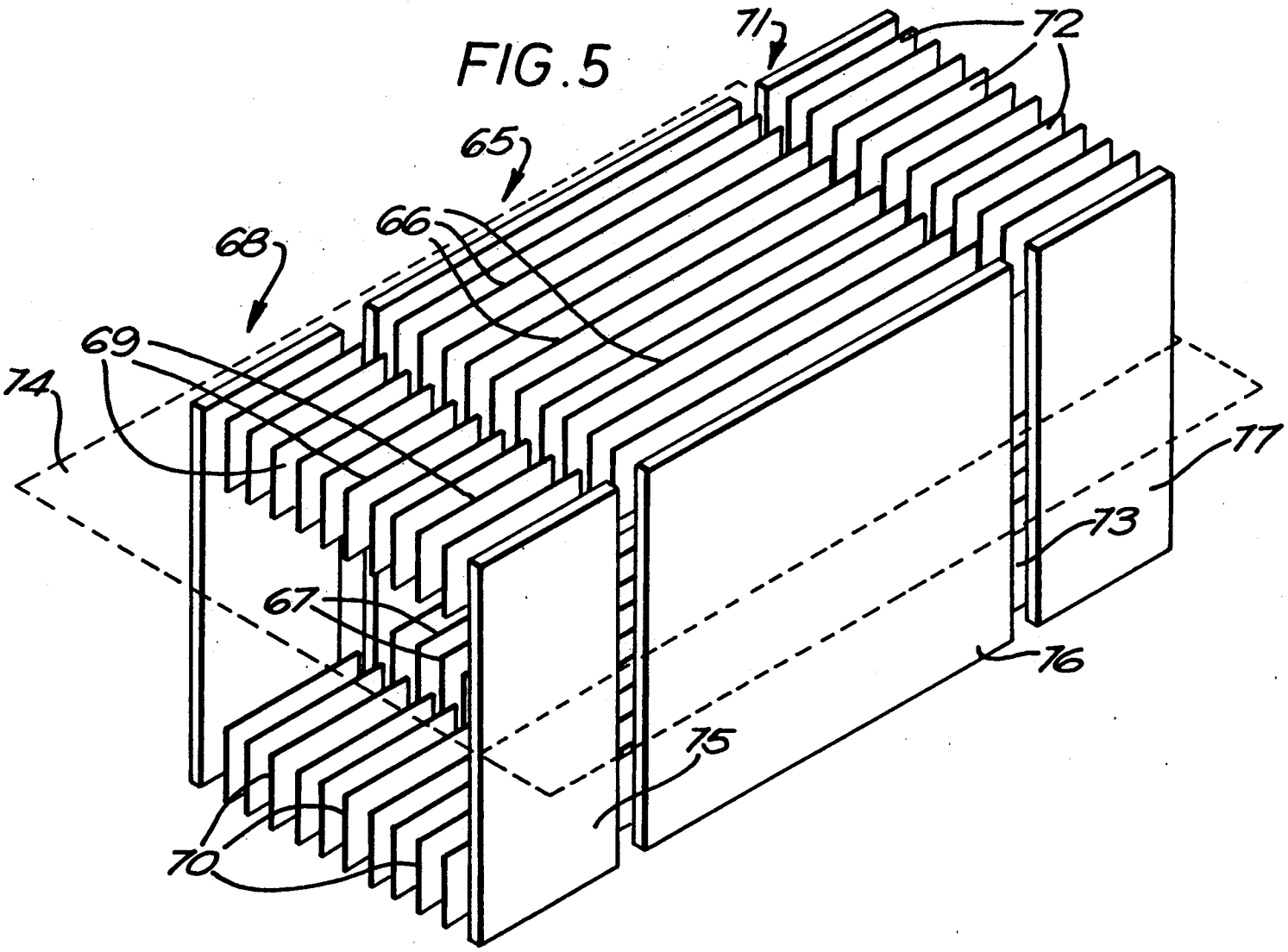
FIG. 5 is a schematic diagram of a more preferred type of analyzer according to the invention.

A similar method of construction may also be employed for the entrance and exit fringing field correctors (68, 71, FIG. 5). A complete analyzer incorporating these can be manufactured economically by extending the insulating plates 78, 79 (FIG. 7) in the direction of the fringing field correctors and providing ridges similar to the ridges 83 on which the electrodes comprising the correction assemblies may be deposited.

Although the ridged structure illustrated in FIG. 7 is the most preferred form it is possible to form the electrodes simply by depositing metallic tracks on flat insulating plates. Analyzers so constructed are not suited to high performance applications, however.

Figure 6:
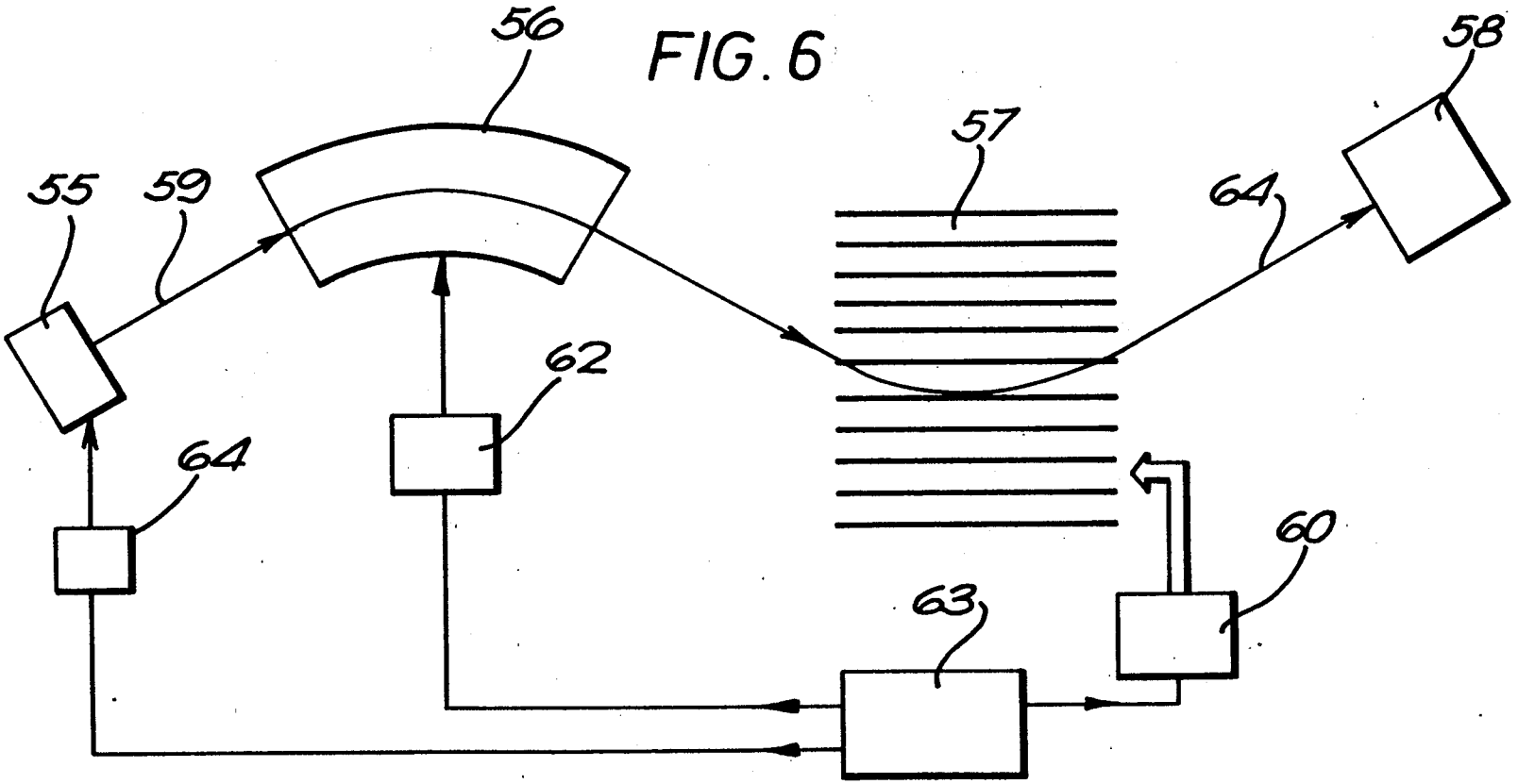
FIG. 6 is a schematic drawing of one type of mass spectrometer according to the invention.

Referring next to FIG. 6, one type of mass spectrometer according to the invention comprises an ion source 55 which emits a beam of ions 59. These pass in turn through a momentum analyzer, in this case a magnetic sector analyzer 56, and a multi-electrode electrostatic analyzer 57, for example as illustrated in FIG. 4. The mass resolved ion beam 61 which exits from the analyzer 57 is collected on a charged-particle detector 58 which comprises a conventional arrangement of a single channel electron multiplier and a collector slit which defines the resolution of the spectrometer. Alternatively, detector 58 may comprise a multi-channel detector capable of simultaneously recording more than one mass-to-charge ratio.

The magnetic sector analyzer 56 and electrostatic analyzer 57 are preferably arranged as a double focusing mass spectrometer, i.e., so that they cooperate to produce an image on the detector which is both direction and velocity focused. However it is also within the scope of the invention to incorporate a multi-electrode analyzer of the type described in other types of mass spectrometer, for example, as an energy filter for improving abundance sensitivity in an isotope ratio spectrometer wherein the filter does not cooperate with a momentum analyzer to form a double focusing mass spectrometer.

Electrical potentials are applied to the electrodes of analyzer 57 by the power supply 60 which is conveniently similar to that shown in FIG. 3. The magnetic sector analyzer 56 is supplied by power supply 62 and the ion source 55 by power supply 64. A computer 63 is used to control supplies 60, 62 and 64. Computer 63 is programmed to set the potentials on the electrodes of analyzer 57 (via the power supply 60) to values which result in an image of the source 55 being formed on the detector 58, as in a conventional double focusing mass spectrometer.

The procedure for the design of a double focusing mass spectrometer according to the invention is similar to that for the design of a conventional double focusing spectrometer, except that the focusing properties of the electrostatic analyzer are determined not by its geometrical characteristics such as radius and sector length but simply by the potentials applied to the electrodes. It is therefore a simple task to change these parameters in order to optimize the performance of the completed spectrometer, in contrast to a conventional instrument.

The invention is not limited to a spectrometer wherein the momentum analyzer precedes the energy analyzer. Advantage is also to be had in the case where the energy analyzer precedes the momentum analyzer. Similarly, a double focusing spectrometer according to the invention may or may not involve the formation of an intermediate image at a crossover between the two analyzers, dependent on the type of double focusing geometry employed.

Figure 8:
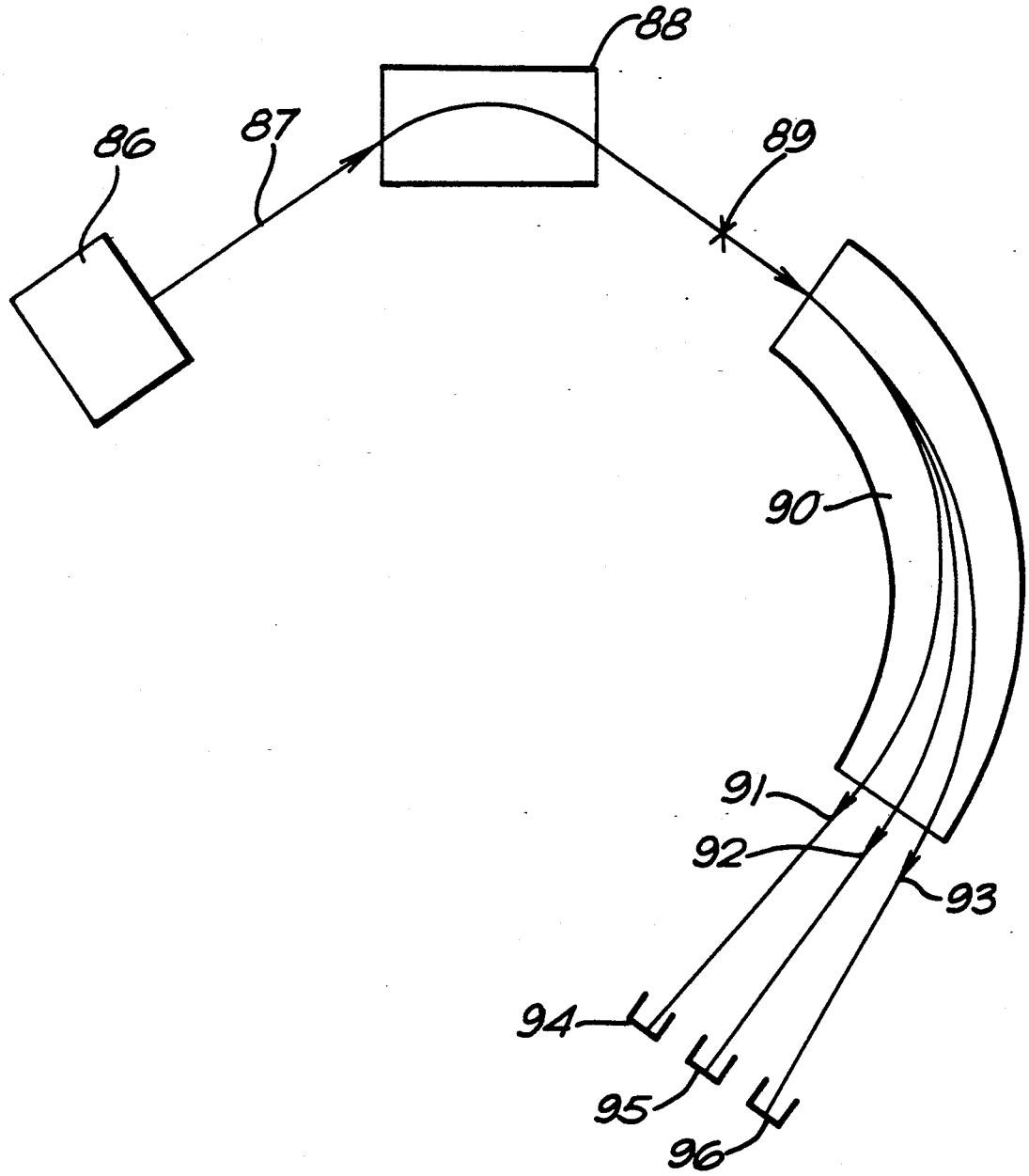
FIG. 8 is a schematic drawing of another type of mass spectrometer according to the invention.

FIG. 8 is a schematic diagram of an isotope ratio spectrometer according to the invention. A charged-particle source 86 generates an ion beam 87 comprising ions characteristic of the element(s) in a sample whose isotopic composition is to be determined. The ion beam 87 enters a multi-electrode analyzer 88 (for example, constructed according to FIG. 4) and is deflected and focused to an intermediate energy dispersed image 89. The ion beam continues through the image 89 into a magnetic sector momentum analyzer 90 which disperses the beam into several beams 91–93 comprising ions of a different isotope. Beams 91–93 are received by a similar number of collectors 94–96, which are typically Faraday cup collectors for maximum accuracy, so that the isotopic composition of the element in question can be determined by simultaneous measurement of signals generated by collectors 94–96.

It is also possible to reverse the order of the analyzers 88 and 90 so that the ion beam 87 passes first into the magnetic sector analyzer 90. Because the focal plane of an electrostatic analyzer according to the invention is more extensive than that of a sector analyzer, it is possible to receive the mass dispersed ion beam at its entrance and form a series of mass-dispersed energy-focused images with sufficient dispersion to allow the collectors 94–96 to be spaced more widely apart than would otherwise be possible. This improves the abundance sensitivity of the spectrometer and facilitates the construction of the collector system.

Figure 9:
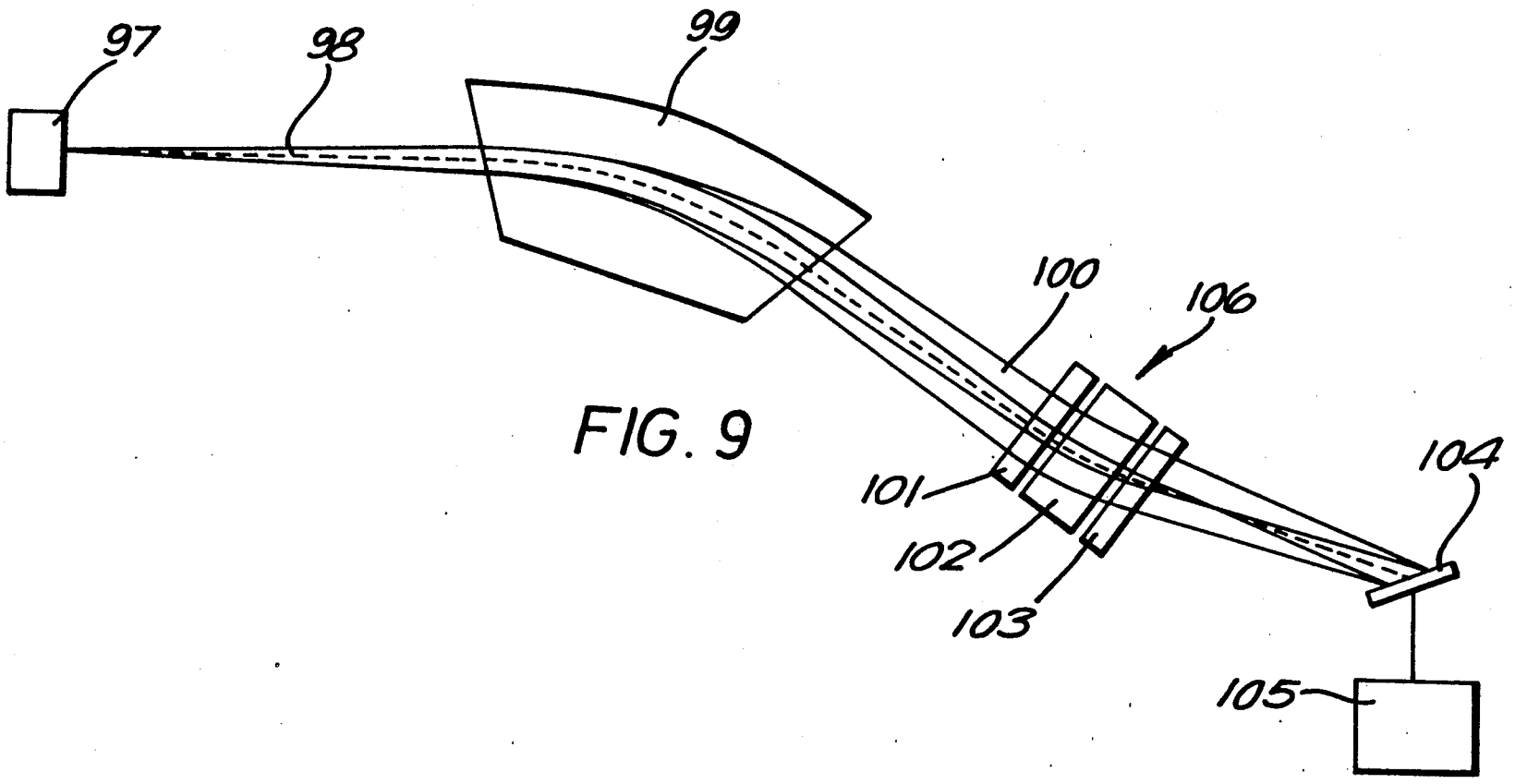
FIG. 9 is a schematic drawing of yet another type of mass spectrometer according to the invention.

FIG. 9 illustrates a mass spectrometer according to the invention which has three analyzer segments each constructed as described. An ion source 97 generates a beam of ions 98 which are dispersed by the magnetic sector analyzer 99 into a plurality of beams 100 according to their mass-to-charge ratios. Beams 100 enter an electrostatic analyzer 106 which comprises three segments 101–103 each of which is capable of dispersing charged particles according to their energy. The analyzer 106 cooperates with the analyzer 99 to produce an image on the detector 104 which is both direction and velocity focused. Detector 104 is a multichannel detector which is capable of detecting a large number of different mass-to-charge ratios simultaneously in conjunction with its control and read-out electronics shown schematically at 105. The large number of adjustable parameters associated with analyzer 106 allows very accurate double focusing to be maintained over a wide range of deflection angles and focal lengths of the analyzer 106. The construction of a very high performance multichannel spectrometer with several alternative detectors is therefore facilitated.

Analyzer segments 101 and 103 may also be used to change the energy of a charged particle beam as it enters or leaves the segment 102. In this application, the electrodes of segments so used are typically all maintained at the same potential.

I claim:

1. An electrostatic analyzer for dispersing a beam of charged particles according to their energy, said analyzer comprising an upper and a lower group of spaced apart linear electrodes respectively disposed above and below said beam, and means for applying electrical potentials to said electrodes, each said group comprising a pair of electrodes between which one or more central electrodes are disposed, the potential of one electrode of the pair being more positive and the potential of the other electrode of the pair being more negative than the potential at which ions comprised in said beam enter the analyzer, and the potentials of all the electrodes comprising each said group progressively increasing from one electrode to the next, thereby providing in a central plane between said groups of electrodes an electrostatic field which is capable of deflecting said charged particles along different curved trajectories according to their energies.

2. An electrostatic analyzer as claimed in claim 1 wherein the linear electrodes comprised in each said group are disposed substantially parallel to one another and are arrayed in a plane parallel to said central plane.

3. An electrostatic analyzer as claimed in claim 1 wherein said upper and lower groups are substantially identical and wherein the electrodes in corresponding positions in each said group are maintained at the same potential.

4. An electrostatic analyzer as claimed in claim 1 wherein one central electrode of each group is maintained at a potential $V_M$ and the potentials of the other electrodes in the group are given by the polynomial expression:

$$V_E = V_M + V_A y_E + V_B y_E^2 + V_C y_E^3 + V_D y_E^4 + \ldots$$

wherein $V_E$ is the potential of a particular electrode, $y_E$ is the distance of said particular electrode from the electrode maintained at $V_M$, and $V_A$, $V_B$, $V_C$, and $V_D$ are constants.

5. An electrostatic analyzer as claimed in claim 4 which generates an energy-dispersed image focused at least to the first order and wherein the coefficients $V_A$ and $V_B$ are respectively selected to set the deflection angle and the focal length of the analyzer.

6. An electrostatic analyzer as claimed in claim 5 wherein the coefficients $V_C$ and $V_D$ are respectively selected to set the focal plane tilt and the focal plane curvature.

7. An electrostatic analyzer as claimed in claim 1 wherein the electrodes at each end of said upper group extend through said central plane to form the corresponding end electrodes of said lower group in order to provide fringing field correction at the sides of said analyzer.

8. An electrostatic analyzer as claimed in claim 1 wherein said electrodes are electrically conductive members spaced apart by insulators.

9. An electrostatic analyzer as claimed in claim 1 wherein two or more of said electrodes in a said group comprise electrically conductive material deposited on an insulating plate.

10. An electrostatic analyzer comprising a main analyzer as claimed in claim 4 and at least one fringing field corrector disposed adjacent to the entrance (or exit) of said main analyzer, said fringing field corrector comprising upper and lower groups of spaced-apart auxiliary electrodes disposed respectively above and below the charged-particle beam as it enters (or leaves) said main analyzer, and wherein all said auxiliary electrodes are maintained at the same potential.

11. An electrostatic analyzer as claimed in claim 10 wherein said upper and lower groups of auxiliary electrodes are respectively arrayed in the same planes as said upper and lower groups of electrodes comprised in said main analyzer, and each said auxiliary electrode is disposed in line with a corresponding electrode in said main analyzer.

12. An electrostatic analyzer as claimed in claim 10 wherein fringing field correctors are provided at the entrance and the exit of said main analyzer and the potential of said auxiliary electrodes is the same as the potential of said beam of charged particles as it approaches said analyzer.

13. An electrostatic analyzer according to claim 12 wherein said potential of said auxiliary electrodes is ground potential.

14. An electrostatic analyzer comprising two or more segments through which the charged particles pass sequentially each said segment comprising an analyzer as claimed in claim 1.

15. A mass spectrometer comprising a source of charged particles, a detector of charged particles, a momentum analyzer for dispersing a beam of charged particles according to their mass-to-charge ratio and an electrostatic analyzer as claimed in claim 1 for dispersing a beam of charged particles according to their energy.

16. A mass spectrometer as claimed in claim 15 wherein said momentum analyzer and said electrostatic analyzer cooperate to form an image on said detector which is both direction and velocity focused.

17. A mass spectrometer as claimed in claim 1 wherein said momentum analyzer is a magnetic sector analyzer.

18. A mass spectrometer as claimed in claim 16 or claim 4 when appended to claim 4 wherein said image is formed in a focal plane, and wherein the coefficient $V_A$ and $V_B$ are selected to cause at least a part of said focal plane to coincide with said detector.

19. A mass spectrometer as claimed in claim 18 wherein the coefficients $V_C$ and $V_D$ are respectively selected to set the focal plane tilt and focal plane curvature to any desired value.

20. A mass spectrometer as claimed in claim 15 wherein said electrostatic analyzer is the final analyzer through which the charged particles pass before reaching said detector.

21. A mass spectrometer as claimed in claim 20 comprising two or more detectors arrayed in said focal plane for simultaneously receiving charged particles of different mass-to-charge ratios.

* * * * *

UNITED STATES PATENT AND TRADEMARK OFFICE

CERTIFICATE OF CORRECTION

PATENT NO. : 5,194,732

DATED : March 16, 1993

INVENTOR(S) : Robert H. Bateman

It is certified that error appears in the above-identified patent and that said Letters Patent is hereby corrected as shown below:

Column 2, line 20, "Y-axis" should be --y-axis--.

Column 2, line 35, "conventiona" should be --conventional--.

Column 3, line 4, "two groups" should be --an upper and a lower group--.

Column 3, line 5, delete "the" after the word "beam".

Column 3, line 5, after the word "beam" insert --and means for applying electrical potentials to said electrodes, each said group comprising a pair of electrodes between which one or--.

Column 3, line 25, "V" should be --$V_M$--

Column 3, line 30, "$V_{AYE}+V_{BYE}2 + V_{CYE}3 + V_{DYE}4 +...$" should be --$V_AY_E +V_BY_E2 + V_CY_E3 + V_DY_E4+...$--

Column 3, line 47, "$E_{1yE}+ E_{2yE}2 + E_{3yE}3 +...$" should be --$E_1Y_E+E_2Y_E^2+E_3Y_E^3+...$--

Column 3, line 49, "YE" should be --$Y_E$--

Column 3, line 54, "$E_{2yE}^2$ and $E_3Y_E^3$" should be --$E_2Y_E^2$ and $E_{3yE}^3$--

Column 7, line 29, "YE" should be --$Y_E$--

UNITED STATES PATENT AND TRADEMARK OFFICE

CERTIFICATE OF CORRECTION

PATENT NO. : 5,194,732

DATED : March 16, 1993

INVENTOR(S) : Robert H. Bateman

It is certified that error appears in the above-identified patent and that said Letters Patent is hereby corrected as shown below:

Column 11, line 50, "$V_{AyE} + V_{ByE}^2 + V_{CyE}^3 + V_{DyE}^4 + \ldots$" should be --$V_A Y_E + V_B Y_E^2 + V_C Y_E^3 + V_D Y_E^4 + \ldots$--

Column 11, line 54, "YE" should be --$Y_E$--

Column 12, line 48, "1" should be --15--

Signed and Scealed this

Eighth Day of March, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,194,732

DATED : 16 March 1993

INVENTOR(S) : Bateman

It is certified that error appears in the above-indentified patent and that said Letters Patent is hereby corrected as shown below:

Column 7, line 19, delete "$Y_E$ and insert --$y_E$--.

Column 7, line 28, delete "$Y_E$ and insert --$y_E$--.

Column 12, line 53, delete "when appended to claim 4" after the numeral "4".

Signed and Sealed this

Nineteenth Day of April, 1994

*Attest:*

Bruce Lehman

BRUCE LEHMAN

*Attesting Officer*

*Commissioner of Patents and Trademarks*